United States Patent [19]

De Vaujany

[11] Patent Number: 4,895,195

[45] Date of Patent: Jan. 23, 1990

[54] APPARATUS FOR VOLUMETRIC DOSING OF A FRAGILE BULK MATERIAL

[75] Inventor: Robert De Vaujany, Genas, France

[73] Assignee: Societe Anonyme dite "Manufacture Lyonnaise de Bouchage", Lyons, France

[21] Appl. No.: 14,411

[22] Filed: Feb. 12, 1987

[30] Foreign Application Priority Data

Feb. 12, 1986 [FR] France ..... 86 02349

[51] Int. Cl.[4] ..... G01F 11/00

[52] U.S. Cl. ..... 141/258; 141/95; 141/250; 222/361

[58] Field of Search ..... 141/258-261, 141/250, 251, 237, 95, 83, 86, 322, 300, 321; 222/56, 64, 344, 361-365

[56] References Cited

U.S. PATENT DOCUMENTS

| | | | |
|---|---|---|---|
| 851,474 | 4/1907 | Abbott | 222/361 X |
| 1,520,017 | 12/1924 | Denton | 222/361 X |
| 2,537,415 | 1/1951 | Loeb et al. | 222/361 X |
| 2,550,240 | 4/1954 | Geiger et al. | 222/361 X |
| 3,106,947 | 10/1963 | Logan | 222/361 X |
| 3,330,311 | 7/1967 | Christine et al. | 222/361 X |
| 3,923,085 | 12/1975 | Nimer | 141/261 |
| 4,127,151 | 11/1978 | Veda et al. | 222/361 X |
| 4,394,941 | 7/1983 | Recine | 222/361 X |
| 4,508,148 | 4/1985 | Trechsel et al. | 141/95 |
| 4,519,425 | 5/1985 | Seidel | 141/86 |

FOREIGN PATENT DOCUMENTS

| | | | |
|---|---|---|---|
| 621291 | 5/1927 | France | 222/361 |

*Primary Examiner*—Ernest G. Cusick

*Attorney, Agent, or Firm*—Herbert Dubno; Andrew M. Wilford

[57] ABSTRACT

An apparatus for dosing a fragile bulk material has a supply bin having an inclined wall formed with a throughgoing aperture and a filler for maintaining the supply bin filled with the bulk material up to a level below and not above the aperture. Thus the wall aperture is always above the level of the material. A slider formed with a throughgoing aperture like the wall aperture is slidable along the wall between a lower position with the slider aperture wholly below the material level and out of alignment with the wall aperture and an upper position with the slider aperture above the level and aligned with the wall aperture. An actuator reciprocates the slider between its positions and thereby fills its aperture with a dose of the material in the lower position, moves the dose up above the level while shedding material atop the slider on movement into the upper position, and drops the dose through the wall aperture when in the upper position.

7 Claims, 2 Drawing Sheets

13
14
5
2
15
14a
3a
3
16
1a
1
8
12
11
4
6
9
10
7
1a
17

APPARATUS FOR VOLUMETRIC DOSING OF A FRAGILE BULK MATERIAL

FIELD OF THE INVENTION

The present invention relates to an apparatus for dosing a fragile bulk material. More particularly this invention concerns such an apparatus for volumetrically dosing dry breakfast cereal and the like.

BACKGROUND OF THE INVENTION

In the production of small packages of light and fragile bulk material like breakfast cereal it is essential to dose the material into the individual packages fairly accurately, and it is also very important not to crush or fragment the material. As a result the standard method used nowadays doses the material by weight, typically shifting a filling chute to the next package when the weight of the package being filled is what it should be. This procedure is relatively tricky, in particular because the very low density of the material requires extremely sensitive weighing and very accurate flow control.

Recourse has therefore been had to volumetric dosing of the material. The simplest systems ape liquid-dosing arrangements with a piston that pushes the material through a tube in doses determined by the piston stroke. Such an arrangement is extremely rough on the material, crushing it much more than can be tolerated in a foodstuff that must reach the consumer in attractive as well as edible condition. It is generally recognized that for best customer appeal the product must have little or no shake, that is tiny nonflake particles.

Another system has a bin filled with the material and having a floor formed by stationary upper and lower plates sandwiching a slider. The plates have holes that are out of line and the slider has an aperture of the same size and alternately alignable with these holes. Reciprocation of the slider moves its aperture first into alignment with the hole of the upper plate so a dose of the bulk material is taken on, and then into alignment with the hole of the lower plate so the dose is dropped therethrough into a waiting container. While being extremely simple in operation, this system has the disadvantage that it partly cuts and fragments the bulk material. Each time the slider aperture moves away from the upper hole much of the material lying at the plane where the upper slider surface meets the lower upper-plate surface is sheared. As mentioned above this is not permissible when the material being packaged is a flake-type food stuff, for instance cornflakes, as it makes the product substantially less attractive for the consumer.

OBJECTS OF THE INVENTION

It is therefore an object of the present invention to provide an improved apparatus for dosing a fragile bulk material.

Another object is the provision of such an apparatus for dosing a fragile bulk material which overcomes the above-given disadvantages, that is which operates in a very simple manner to accurately dose the material while subjecting it to no cutting or shearing action.

SUMMARY OF THE INVENTION

An apparatus for dosing a fragile bulk material according to the invention has a supply bin having an inclined wall formed with a throughgoing aperture and a filler for maintaining the supply bin filled with the bulk material up to a level below and not above the aperture. Thus the aperture is always above the level of the material. A slider formed with a throughgoing aperture like the wall aperture is slidable along the wall between a lower position with the slider aperture wholly below the material level and out of alignment with the wall aperture and an upper position with the slider aperture above the level and aligned with the wall aperture. An actuator reciprocates the slider between its positions and thereby fills its aperture with a dose of the material in the lower position, moves the dose up above the level while shedding material atop the slider on movement into the upper position, and drops the dose through the wall aperture when in the upper position.

Thus with the system of this invention the bulk material is never subject to crushing or compaction since it moves wholly by its own weight. In addition there is no shearing or cutting action whatsoever since there are only two times that the apertures move past each other. On the upward stroke as the apertures align the material simply drops through, so there is no shearing action, and on the downward stroke the two apertures are clear so there is nothing to shear.

According to this invention the supply bin is formed along the lower edge of the side wall with a gap through which the slider extends. In addition the slider fits in the gap with sufficient play to permit fines from the material to flow out of the bin between the slider and the gap. A tray or the like is provided below the bin for catching fines flowing out of the bin through the gap. Thus the system separates out undesirable fines.

The actuator of this invention is mounted on the outside of the bin and the filler includes a level sensor for maintaining the material level generally constant. The side wall extends at an angle of 30° to 45° to the horizontal and the slider and side wall are both formed by planar plates.

For maximum efficiency the slider is formed with a row of such slider apertures and the wall is formed with a complementary row of such wall apertures. Thus it is possible at one time to fill a plurality of recipients which are automatically moved in and out in step with the reciprocation of the slider.

The volume of the slider aperture is determined by the angle formed by the side wall with the vertical and the desired dose volume. In other words as the side wall gets steeper the volume of the slider aperture must be increased to compensate for material that flows out of this slider aperture on the upstroke.

DESCRIPTION OF THE DRAWING

The above and other features and advantages will become more readily apparent from the following, reference being made to the accompanying drawing in which.

SPECIFIC DESCRIPTION

Figure 1:
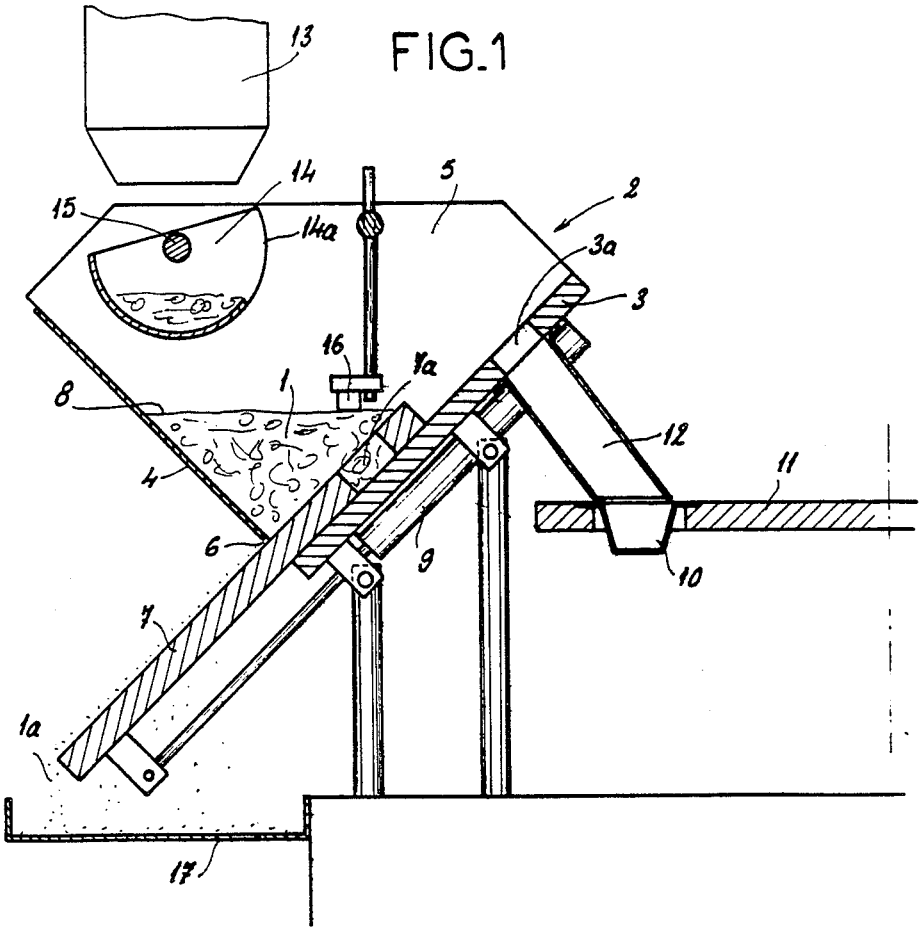
FIG. 1 is a vertical section through the apparatus in the lower position.

As seen in the drawing the apparatus of this invention serves to fill bulk material, here cornflakes 1, into individual recipients 10. To this end the apparatus has a bin 2 formed by a pair of side walls 3 and 4 extending at a right angle to each other and symmetrically flanking an upright plane and by a pair of triangular end panels 5.

The walls 3 and 4 do not actually meet, but instead define a gap 6 extending the full length (here perpendicular to the plane of the views) of the bin 2 and normally blocked by a slider plate 7.

The bin 2 is maintained full generally to a level 8 by an automatic filling apparatus comprised of a supply hopper 13 and an oscillating feed 14. A level detector 16 oscillates the feed 14, which is a part-cylindrical shell pivotal about its horizontal axis 15, when the actual level of the flakes drops substantially below the level 8 to replenish the amount in the bin 2. When the actual level of the cornflake 1 is substantially at the level 8 the detector 16 prevents the feed 14 from working.

The one side wall 3 is formed by a thick plate having in a region well above the level 8 a longitudinal row of throughgoing apertures 3*a* which can be round or polygonal in shape. Similarly the slider 7 is formed by a thick plate having an identically spaced row of apertures 7*a* of the same shape. The apertures 7*a* can be the same size as the apertures 3*a* or somewhat smaller but in no case should be larger. Secured underneath the stationary side wall 3 are chute tubes 12 that lead from the apertures 3*a* to respective carousels 11 that hold the recipients 10.

Figure 2:
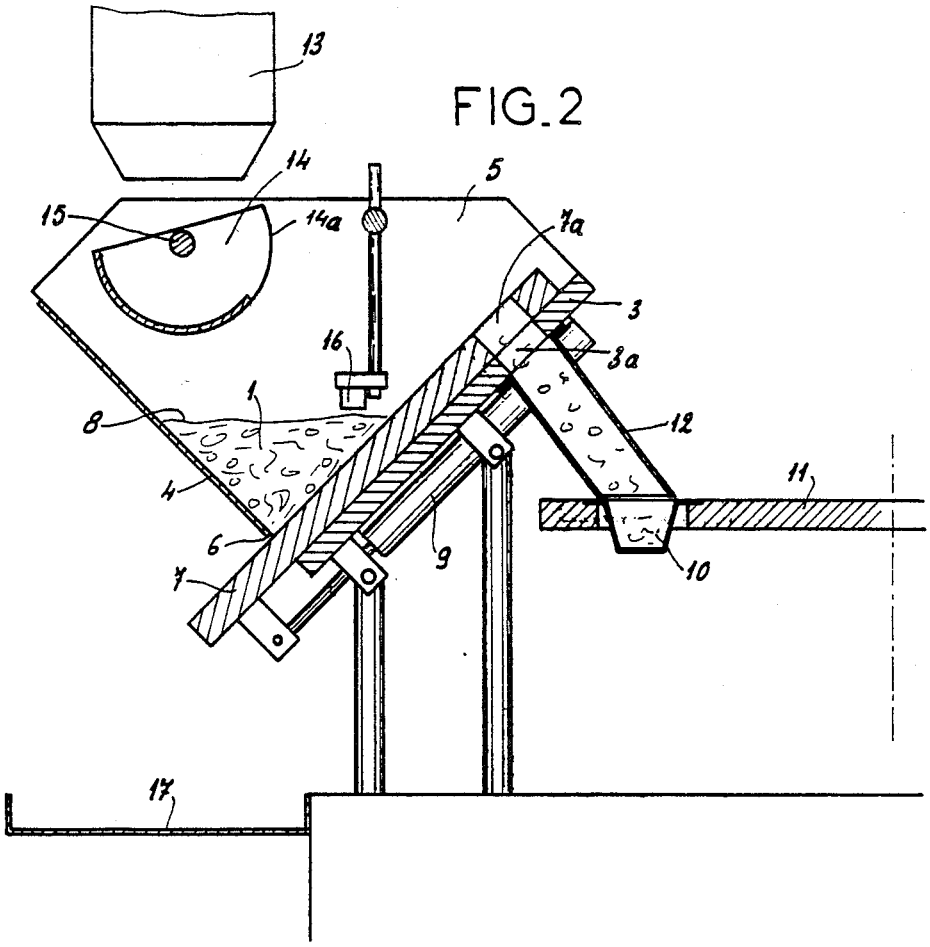
FIG. 2 is another vertical section through the apparatus, but in the upper position.

A double-acting ram 9 secured underneath the side wall 3 can reciprocate the slider 7 between the lower position of FIG. 1 in which the apertures 3*a* and 7*a* are out of alignment and the apertures 7*a* are below the level 8 and the upper position of FIG. 2 where the apertures 3*a* and 7*a* are aligned.

Thus when the slider 7 is in the lower position the somewhat fluent bulk material will fill the apertures 7*a*. Subsequent movement of the slider 7 to move the apertures 7*a* up out of the cornflakes 1 entrains in each of the apertures 7*a* a dose of the flakes 1 whose volume is primarily determined by the thickness of the slider 7 and the area of the apertures 7*a*. Since the wall 3 is at an incline of normally between 30° and 45° some of the material in the apertures 7*a* will slide out so that the aperture volume should be slightly more than the desired dose volume. In any case as the slide 7 moves into the upper position the flakes 1 atop it above the level 8 will slide back down. Finally when the apertures 3*a* and 7*a* align, the doses thus picked up will drop down through the chutes 12 into the recipients.

The fit of the slider 7 in the gap 6 between the side walls 3 and 4 is somewhat loose so that any fines or crumbs 1*a* constituting shake in the bottom of the bin 2 can filter out here, landing in a catchment tray 17. These crumbs 1*a* therefore not only cannot pack and block the slide 7, but they are saved for reuse. In addition such construction in effect makes the dosing apparatus a classifying device that eliminates undesirable fines from the final stage of packaging.

The system of the invention treats the flakes 1 very gently. The action of the slider 7 moving back and forth under the mass of flakes in the bin 2 subjects them to modest abrasion at the worst, since the upper edge of the slider 7 never dips below the level 8. Furthermore the flakes 1 move only by their own weight into the apertures 7*a* and thence down the chutes to the recipients 10, so that there is no piston-like crushing or compaction action.

I claim:

1. An apparatus for dosing a fragile bulk material, the apparatus comprising:

a supply bin having an inclined side wall formed as a planar plate, forming an acute angle with the horizontal, and formed with a throughgoing aperture;

means for filling the bin with the bulk material to a predetermined level below the aperture and for maintaining this level below the aperture;

a slider formed as a planar plate with a throughgoing aperture like the wall aperture, sitting flat on the plate of the side wall, and slidable while in contact with the bulk material filling the bin along the wall between a lower position with the slider aperture wholly below the material level and to of alignment with the wall aperture and an upper position with the slider aperture above the level and aligned with the wall aperture; and actuator means for reciprocating the slider between its positions and thereby filling its aperture with a dose of the material in the lower position, moving the dose up above the level while shedding material atop the slider on movement into the upper position, and dropping the dose through the wall aperture when in the upper position.

2. The dosing apparatus defined in claim 1 wherein the supply bin is formed along the lower edge of the side wall with a gap through which the slider extends.

3. The dosing apparatus defined in claim 2 wherein the slider fits in the gap with sufficient play to permit fines from the material to flow out of the bin between the slider and the gap, the apparatus further comprising means below the bin for catching fines flowing out of the bin through the gap.

4. The dosing apparatus defined in claim 2 wherein the actuator means is mounted on the outside of the bin.

5. The dosing apparatus defined in claim 1 wherein the filling means includes a level sensor for maintaining the material level generally constant.

6. The dosing apparatus defined in claim 1 wherein the side wall extends at an angle of 30° to 45° to the horizontal.

7. The dosing apparatus defined in claim 1 wherein the volume of the slider aperture is determined by the angle formed by the side wall with the vertical and the desired dose volume.

* * * * *